US007145259B2

(12) United States Patent
Spellman et al.

(10) Patent No.: US 7,145,259 B2
(45) Date of Patent: Dec. 5, 2006

(54) ENGINE STARTING MOTOR ANTI-MILLING DEVICE

(75) Inventors: James A. Spellman, Noblesville, IN (US); David A. Fulton, Anderson, IN (US); Ralph H. Johnston, Anderson, IN (US)

(73) Assignee: Remy Inc., Anderson, IN (US)

( * ) Notice: Subject to any disclaimer, the term of this patent is extended or adjusted under 35 U.S.C. 154(b) by 92 days.

(21) Appl. No.: 10/985,819

(22) Filed: Nov. 10, 2004

(65) Prior Publication Data

US 2005/0099009 A1 May 12, 2005

Related U.S. Application Data

(60) Provisional application No. 60/519,052, filed on Nov. 11, 2003.

(51) Int. Cl.
*F02N 11/08* (2006.01)

(52) U.S. Cl. ..... 290/38 R; 290/48; 123/179.3

(58) Field of Classification Search ..... 290/38 R, 290/38 C, 48; 123/179.1, 179.3; 307/10.6
See application file for complete search history.

(56) References Cited

U.S. PATENT DOCUMENTS 3,949,289 A * 4/1976 Day ..... 320/117
4,082,992 A * 4/1978 Day ..... 320/117
4,412,137 A * 10/1983 Hansen et al. ..... 307/10.6
4,862,010 A 8/1989 Yamamoto
4,896,637 A 1/1990 Yamamoto
4,916,327 A 4/1990 Cummins
5,146,095 A 9/1992 Tsuchiya et al.
5,155,374 A 10/1992 Shirata et al.
5,157,267 A * 10/1992 Shirata et al. ..... 290/38 R
5,207,194 A 5/1993 Clerici
5,345,901 A 9/1994 Siegenthaler et al.
5,347,419 A 9/1994 Caron et al.
5,383,428 A 1/1995 Fasola et al.
5,563,454 A * 10/1996 Araki et al. ..... 307/10.6
5,622,148 A 4/1997 Xue et al.
5,925,938 A 7/1999 Tamor
6,024,065 A 2/2000 Hojna et al.
6,104,157 A 8/2000 Kramer et al.
6,242,887 B1 6/2001 Burke
6,308,674 B1 10/2001 Ruehle et al.
6,323,562 B1 11/2001 Renner et al.
6,325,035 B1 * 12/2001 Codina et al. ..... 123/179.1
6,354,257 B1 3/2002 Marshall et al.
6,362,595 B1 3/2002 Burke
6,426,606 B1 7/2002 Purkey
6,516,767 B1 2/2003 Maillet et al.
6,531,787 B1 3/2003 Koelle et al.
6,653,807 B1 11/2003 Saito et al.

* cited by examiner

*Primary Examiner*—Bentsu Ro
(74) *Attorney, Agent, or Firm*—Ice Miller LLP

(57) ABSTRACT

A power module is connected to the starter, alternator, and battery for an internal combustion engine. The power module includes one or more capacitors and delay timer. When the ignition switch closes, the battery of the starting system provides current to the starter motor, causing the starter solenoid to close the starter contacts, and bring a starter pinion gear into engagement with a flywheel ring gear. The delay timer does not allow the capacitor to immediately deliver current to the starter motor, but implements a short delay before the capacitor's current is released to the starter motor. This short delay increases the chance for full engagement between the starter pinion and the flywheel ring gear, thereby reducing the likelihood of milling when the starter motor provides torque to the starter pinion.

21 Claims, 4 Drawing Sheets

ENGINE STARTING MOTOR ANTI-MILLING DEVICE

This application claims the benefit of U.S. Provisional Patent Application Ser. No. 60/519,052, filed Nov. 11, 2003, the disclosure of which is incorporated by reference.

BACKGROUND

In a typical motor vehicle having an internal combustion engine and an electric starter motor according to the prior art, the operator of the vehicle cranks the engine by turning a key or pressing a button that closes an ignition switch. When the ignition switch closes, electric current is provided to the windings of an electric starter motor solenoid. Upon excitation of the solenoid, a plunger rod carried within the solenoid is caused to move in a linear direction. A linking rod connects one end of the plunger rod to the starter motor's pinion gear drive shaft. As the plunger rod moves, it causes the linking rod to rotate about a pivot point. Rotation of the linking rod about the pivot point moves the pinion gear drive shaft in a linear direction toward the flywheel ring gear of the motor vehicle engine.

Upon reaching the ring gear, the teeth of the pinion gear are designed to mesh with the teeth of the ring gear. To encourage full engagement of the pinion gear teeth and the ring gear, a small amount of axial rotation may be provided to the pinion gear as it moves toward the ring gear. Such rotation may be imparted, for example, with a helical spline gear positioned on the drive shaft of the electrical motor. The starter motor contacts then are closed and electric current is provided to the windings of the electric motor, causing the drive shaft of the electric motor to rotate the pinion gear. If the pinion gear teeth are engaged with the ring gear, rotation of the drive shaft and pinion gear causes the ring gear to rotate and crank the automobile engine.

A problem exists in with such a prior art starter motor. When the starter motor contacts are closed, a high inrush current from the battery or other power storage device causes the rotation of the starter motor drive shaft and pinion gear to accelerate rapidly. If there is any misalignment between the teeth of the pinion gear and the teeth of the ring gear, the pinion gear and ring gear may abut instead of meshing together. The rotation of the pinion gear may encourage the teeth to engage, but this too often is not the case if the pinion gear immediately begins rotating at a high rate. Instead, if the pinion gear teeth and the ring gear teeth are not enmeshed deeply enough when the electric motor transmits torque through the starter motor drive shaft, the pinion gear teeth can mill against the ring gear teeth rather than starting the engine. This also can cause damage to the starter motor and the ring gear.

Accordingly, it would be desirable to provide an anti-milling system for automotive starters. Such a system will promote the full engagement of the teeth of the starter motor pinion gear and the teeth of the ring gear prior to the acceleration of the starter motor drive shaft.

SUMMARY

In an embodiment, the present invention comprises a starting system for an internal combustion engine. The starting system of this embodiment comprises a battery, an electric starter motor, a first switch operable to make and break an electrical connection between the battery and the electric starter motor, means for storing an electric charge, a second switch operable to make and break an electrical connection between the electric starter motor and the means for storing an electric charge, and a sensor operable to detect a predetermined electrical parameter in the electrical connection between the battery and the electric starter motor and to transmit a signal actuating the second switch. In an aspect of this embodiment, the signal actuating the second switch comprises a control signal causing the second switch to make an electrical connection between the electric starter motor and the means for storing an electric charge, where the control signal is transmitted a predetermined time after the predetermined electrical parameter is detected. In an aspect of this embodiment, the signal actuating the second switch comprises a control signal causing the second switch to break an electrical connection between the electric starter motor and the means for storing an electric charge, where the control signal is transmitted a predetermined time after the predetermined electrical parameter is detected. In an aspect of this embodiment, the means for storing an electric charge is one or more capacitors and/or one or more batteries.

In an embodiment, the present invention comprises a starting system for an internal combustion engine. The starting system for an internal combustion engine of this embodiment comprises an electric starter motor, a battery electrically connected to the electric starter motor via a switched connected, and a unitary control module. The unitary control module of this embodiment comprises a housing, means for storing an electric charge disposed within the housing, a sensor disposed within the housing, and a switch disposed within the housing. The sensor is operable to detect a predetermined electrical parameter in the switched electrical connection between the electric starter motor and the battery. The switch is operable to make and break an electrical connection between the means for storing an electric charge and the starter motor in response to a signal from the sensor. In an aspect of this embodiment, the signal comprises a control signal causing the switch to make an electrical connection between the starter motor and the means for storing an electric charge, where the control signal is transmitted a predetermined time after the predetermined electrical parameter is detected. In an aspect of this embodiment, the signal comprises a control signal causing the switch to break an electrical connection between the electric starter motor and the means for storing an electric charge, where the control signal is transmitted a predetermined time after the predetermined electrical parameter is detected. In an aspect of this embodiment, the means for storing an electric charge is one or more capacitors and/or one or more batteries.

In an embodiment, the present invention comprises a starting system for an internal combustion engine. The starting system of this embodiment comprises a battery having a positive terminal and a negative terminal, an electric starter motor, a first switch operable to make and break a electrical connection between the battery and the electric starter motor, means for storing an electric charge having a positive lead and a negative lead, and a current limiting device. The current limiting device is electrically connected between the positive lead of the means for storing an electric charge and the electric starter motor. The current limiting device is operable to permit pulses of direct current to flow from the positive lead of the means for storing an electric charge to the electric starter motor. In an aspect of this embodiment, the means for storing an electric charge is one or more capacitors and/or one or more batteries.

In an embodiment, the present invention comprises a starting system for an internal combustion engine. The starting system of this embodiment comprises a battery, an electric starter motor comprising a moveable pinion gear drive shaft, a first switch operable to make and break an electrical connection between the battery and the electric starter motor, means for storing an electric charge, a second switch operable to make and break an electrical connection between the electric starter motor and the means for storing an electric charge, and a sensor operable to actuate the second switch upon detecting that the moveable pinion gear drive shaft is in a predetermined position. In an aspect of this embodiment, the means for storing an electric charge is one or more capacitors and/or one or more batteries.

In an embodiment, the present invention comprises a starting system for an internal combustion engine. The starting system of this embodiment comprises a battery having a positive terminal and a negative terminal, an electric starter motor, a first switch operable to make and break a electrical connection between the battery and the electric starter motor, and a current boosting device electrically connected between the positive terminal of the battery and the electric starter motor. The current boosting device of this embodiment is operable to enhance the cranking current provided to the electric starter motor.

BRIEF DESCRIPTION OF THE DRAWINGS

The features and advantages of this invention, and the methods of obtaining them, will be more apparent and better understood by reference to the following descriptions of embodiments of the invention, taken in conjunction with the accompanying drawings, wherein.

DESCRIPTION

Figure 1:
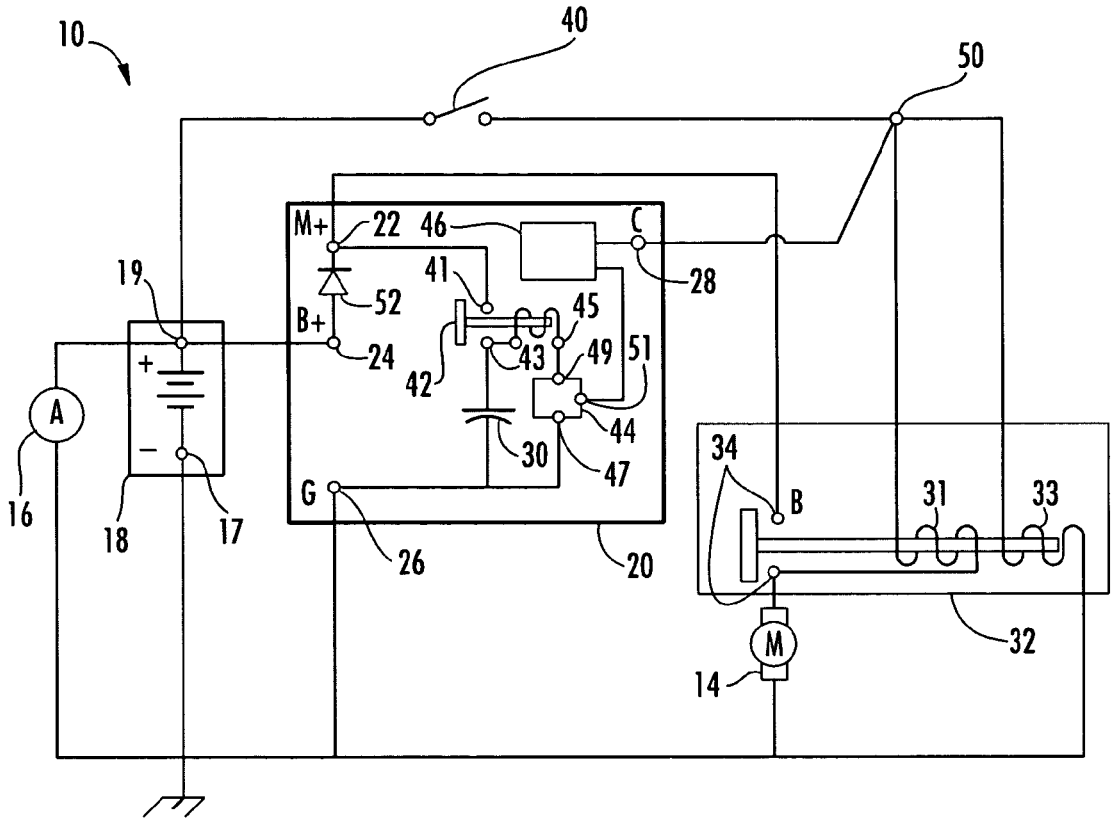
FIG. 1 is a schematic diagram showing an engine starting motor anti-milling device according to an embodiment of the present invention connected to other components of an internal combustion engine starting circuit.

FIG. 1 shows a schematic diagram of an internal combustion engine starting system 10 according to an embodiment of the present invention. Starting system 10 of FIG. 1 comprises starter motor 14, alternator 16, battery 18, power module 20, solenoid 32, and switch 40.

Starter motor 14 is an internal combustion engine starter motor comprising a pinion gear (not shown). Starter motor 14 is installed in a typical arrangement with an internal combustion engine (not shown), where the pinion gear of starter motor 14 drives a flywheel ring gear (not shown) on the internal combustion engine in order to crank the internal combustion engine. Solenoid 32 is an internal combustion engine starter motor solenoid comprising pull-in coil 31, hold-in coil 33, and contacts 34.

Alternator 16 is an internal combustion engine alternator. After the internal combustion engine has started, the alternator 16 is mechanically driven by the internal combustion engine and provides electric current to recharge battery 18, and to fulfill the electrical needs of the vehicle or apparatus in which the internal combustion engine is installed.

Battery 18 is a battery, such as an automotive battery, comprising negative terminal 17 and positive terminal 19. Battery 18 is connected to alternator 16 such that battery 18 can be charged by the electrical current delivered from alternator 16. Switch 40 is an ignition switch of a type known in the art.

Power module 20 comprises M(+) terminal 22, B(+) terminal 24, Neg(−) terminal 26, C terminal 28, capacitor 30, relay 42, relay 44, control logic device 46, and, optionally, diode 52. Relay 42 is an electrical relay comprising terminals 41, 43, and 45. Relay 42 is shown in FIG. 1 as an electromechanical relay, however it is within the scope of the present invention to deploy a solid state relay as relay 42. Relay 44 is an electrical relay comprising terminals 47, 49, and 51. Relay 44 is shown in FIG. 1 as a solid state relay, however it is within the scope of the present invention to deploy an electromechanical relay as relay 44. Terminal 45 of relay 42 is electrically connected to terminal 49 of relay 44.

In an embodiment, capacitor 30 is an electric double layer capacitor of the type referred to as a "super capacitor" or an "ultra capacitor." In an alternative embodiment, capacitor 30 may comprise a bank of capacitors. As shown FIG. 1, the positive lead of capacitor 30 is connected to terminal 43 of relay 42. The negative lead of capacitor 30 is connected to Neg(−) terminal 26 and to terminal 47 of relay 44.

Control logic device 46 is electrically connected to C terminal 28 and to terminal 51 of relay 44. The function of control logic device 46 according to the present invention is discussed hereinafter. The function of control logic device 46 may be deployed in a number of different physical forms as may occur to one of skill in the art. For example, control logic device 46 may be comprised of electronic logic devices or may comprise a microprocessor and associated software.

B(+) terminal 24 is electrically connected to the positive terminal 19 of the battery 18. C terminal 28 is electrically connected to node 50, which is in the electrical path between the starter switch 40 and the solenoid 32. The M(+) terminal 22 is electrically connected to B(+) terminal 24, to terminal 41 of relay 42, and to contacts 34. Diode 52 may be included between the M(+) terminal 22 and B(+) terminal 24 to prevent discharging of capacitor 30 into battery 18. When relay 42 is closed, M(+) terminal 22 is electrically connected to capacitor 30. When contacts 34 are closed, M(+) terminal 22 is electrically connected to starter motor 14. Neg(−) terminal 26 is electrically connected to ground.

In an embodiment, power module 20 comprises an insulated casing with capacitor 30, relay 42, relay 44, and control logic 46 contained inside the insulated casing, and M(+) terminal 22, B(+) terminal 24, Neg(−) terminal 26, and C terminal 28 protruding through the insulated case to electrically connect capacitor 30, relay 42, relay 44, and control logic 46 to other components of the electrical system.

In the embodiment of starting system 10 shown in FIG. 1, battery 18 and capacitor 30 are available to provide cranking current to starter motor 14. When switch 40 is closed, current flows from battery 18 to pull-in coil 31 and hold-in coil 33 of solenoid 32, causing the contacts 34 to close. Closing contacts 34 short-circuits pull-in coil 31, and causes the pinion gear of starter motor 14 to engage the flywheel ring gear of the internal combustion engine.

When switch 40 is closed, the current flow/voltage change is detected by control logic device 46 at node 50. Upon sensing of this current/voltage change, control logic device 46 implements a short delay (e.g., less than one second) before providing a control signal to relay 44. When this control signal is applied to relay 44, a path is established between the windings of relay 42 and ground. Current flows through the windings of relay 42, closing the relay contacts and establishing an electrical connection between capacitor 30 and M(+) terminal 22. This allows the current from capacitor 30 to be delivered to starter motor 14 through closed contacts 34. Because of the delay implemented by control logic device 46, the current from capacitor 30 is not delivered to starter motor 14 until the pinion gear of starter motor 14 has been given the opportunity to fully engage the flywheel ring gear of the internal combustion engine.

In an embodiment of the present invention, control logic device 46 is designed to close relay 44 two-tenths (0.2) of a second after switch 40 is closed, and to open relay 44 thirty (30) seconds later or twenty-five (25) seconds after sensing a condition of greater than 14 volts at node 50. Other timing parameters may be selected according to the needs of a practitioner of the present invention, with each selected parameter falling within the scope of the present invention.

Because relay 44 is closed for a period of time after the internal combustion engine is started, capacitor 30 is allowed to be recharged by alternator 16. Once capacitor 30 is recharged, it must be prevented from discharging back into the battery. Thus, relay 44 is opened after a predetermined period of time, or upon the sensing of certain conditions. In an embodiment, control logic device 46 also is designed to open relay 44 if a voltage of less than six volts is sensed at node 50.

Figure 2:
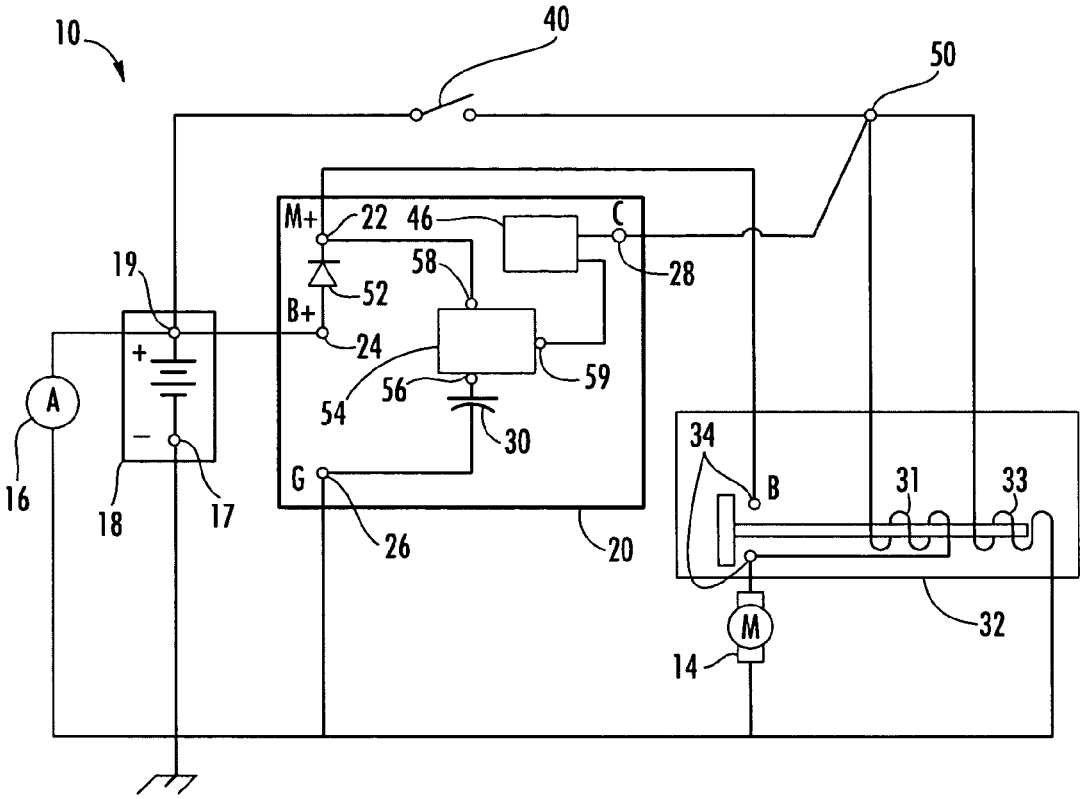
FIG. 2 is a schematic diagram showing an engine starting motor anti-milling device according to an embodiment of the present invention connected to other components of an internal combustion engine starting circuit.

FIG. 2 shows a schematic diagram of another embodiment of internal combustion engine starting system 10 according to the present invention. The embodiment of starting system 10 of FIG. 2 comprises many of the same elements shown in FIG. 1. However, in the embodiment of starting system 10 of FIG. 2, relay 42 and relay 44 are replaced by a single relay 54. In the embodiment shown in FIG. 2, relay 54 is a solid state relay comprising terminals 56, 58, and 59, however it is within the scope of the present invention to use an electromechanical relay as relay 54. Terminal 56 of relay 54 is electrically connected to the positive lead of capacitor 30. Terminal 58 of relay 54 is electrically connected to M(+) terminal 22. Terminal 59 of relay 54 is electrically connected to control logic device 46.

In the embodiment of starting system 10 shown in FIG. 2, when switch 40 is closed, the current flow/voltage change is detected by control logic device 46 at node 50. Upon sensing of this current/voltage change, control logic device 46 implements a short delay (e.g., less than one second) before providing a control signal to relay 54. When this control signal is applied to relay 54, relay 54 establishes an electrical connection between capacitor 30 and M(+) terminal 22. This allows the current from capacitor 30 to be delivered to starter motor 14 through closed contacts 34. Because of the delay implemented by control logic device 46, the current from capacitor 30 is not delivered to starter motor 14 until the pinion gear of starter motor 14 has been given the opportunity to fully engage the flywheel ring gear of the internal combustion engine.

In an embodiment of the present invention, control logic device 46 is designed to close relay 54 two-tenths (0.2) of a second after switch 40 is closed, and to open relay 54 thirty (30) seconds later or twenty-five (25) seconds after sensing a condition of greater than 14 volts at node 50. Other timing parameters may be selected according to the needs of a practitioner of the present invention, with each selected parameter falling within the scope of the present invention.

Because relay 54 is closed for a period or time after the internal combustion engine is started, capacitor 30 is allowed to be recharged by alternator 16. Once the capacitor is recharged, it must be prevented from discharging back into the battery. Thus, relay 54 is opened after a predetermined period of time, or upon the sensing of certain conditions. In an embodiment, control logic device 46 also is designed to open relay 54 if a voltage of less than six volts is sensed at node 50.

As described above, power module 20 not only provides an additional power source for cranking an internal combustion engine, but also implements a delay between the time the ignition switch is closed and the time when the additional power source is called upon to provide cranking power for the internal combustion engine. In particular, power module 20 allows only one power source (e.g., a standard battery) to be used when the pinion gear is moved into engagement with the flywheel ring gear, thereby limiting the rotational speed and force of the pinion gear as it moves into engagement with the flywheel ring gear. This reduces the chance for less than full engagement between the pinion gear and flywheel ring gear as they are moved together, and reduces the chance for milling between the pinion gear and ring gear once the drive shaft of the starter motor transmits torque to the pinion gear.

Figure 3:
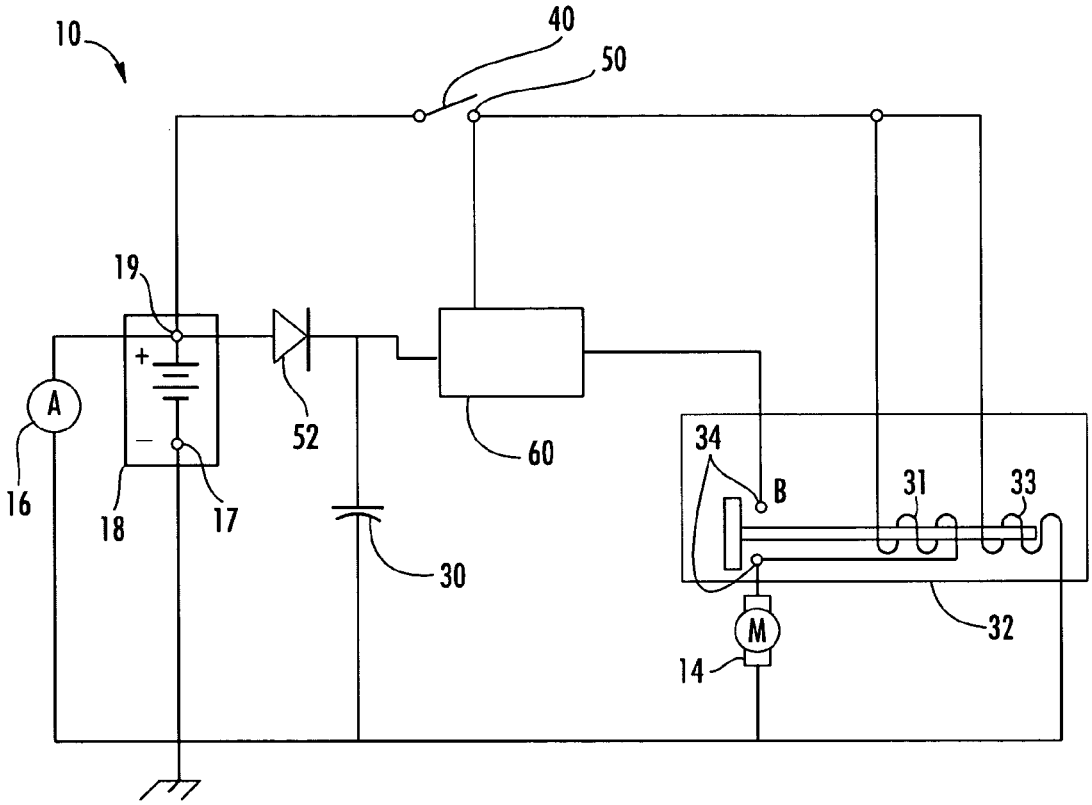
FIG. 3 is a schematic diagram showing an engine starting motor anti-milling device according to an embodiment of the present invention connected to other components of an internal combustion engine starting circuit.

FIG. 3 shows a schematic diagram of a internal combustion engine starting system 10 according to another embodiment of the present invention. Starting system 10 of FIG. 3 comprises starter motor 14, alternator 16, battery 18, capacitor 30, solenoid 32, switch 40, optional diode 52, and current limiting device 60. Starter motor 14, alternator 16, battery 18, capacitor 30, solenoid 32, switch 40, and optional diode 52 are described above in reference to FIGS. 1 and 2. Current limiting device 60 comprises a pulse width modulation circuit designed to interrupt direct current at predetermined intervals, thereby producing pulses of direct current. In an embodiment, current limiting device 60 comprises a DC chopper device.

In the embodiment of starting system 10 shown in FIG. 3, when switch 40 is closed, current flows from battery 18 to pull-in coil 31 and hold-in coil 33 of solenoid 32, causing contacts 34 to close. Closing contacts 34 short-circuits pull-in coil 31, and causes the pinion gear (not shown) of starter motor 14 to engage the flywheel ring gear of the motor vehicle engine. The current flow/voltage change through switch 40 is detected by current limiting device 60 at node 50. Upon sensing of this current/voltage change, current limiting device 60 operates to interrupt direct current from battery 18 and capacitor 30 at predetermined intervals. Pulses of direct current are thereby delivered to motor 14. After a predetermined period of time, current limiting device 60 ceases its direct current pulsing effect, and uninterrupted direct current from battery 18 and capacitor 30 then is delivered to motor 14. The effect of the temporary direct current pulsing created by current limiting device 60 is to reduce the rotational acceleration of starter motor 14, thus enhancing the probability of proper engagement between the pinion gear and the flywheel ring gear before the full current from battery 18 and capacitor 30 is delivered to starter motor 14.

In the embodiments shown in FIGS. 1–3, an electric double layer capacitor is deployed as an additional voltage source for providing internal combustion engine cranking current. However, any number of voltage sources can be used, such as one or more additional batteries. These additional voltage sources enhance battery 18 during engine cranking, and help maintain battery 18 at a higher state of charge, thereby extending the life of battery 18.

In yet another embodiment, starting system 10 is adapted to include a sensor (not shown) that provides positional information about the pinion gear of motor 14. In the embodiment of starting system 10 shown in FIGS. 1 and 2, such a sensor may be used in lieu of control logic device 46. In operation, the sensor is operable to detect when the pinion gear of motor 14 has moved to a point where it necessarily must be engaged with the internal combustion engine ring gear. When this degree of movement is detected, the sensor is operable to actuate relay 44 (in the embodiment of FIG. 1) or relay 54 (in the embodiment of FIG. 2), thereby making the electrical connection between capacitor 30 and motor 14. In the context of the embodiment shown in FIG. 3, when this degree of movement of the pinion gear is detected, the sensor is operable to cause current limiting device 60 to permit uninterrupted direct current from battery 18 and capacitor 30 to be delivered to motor 14.

Figure 4:
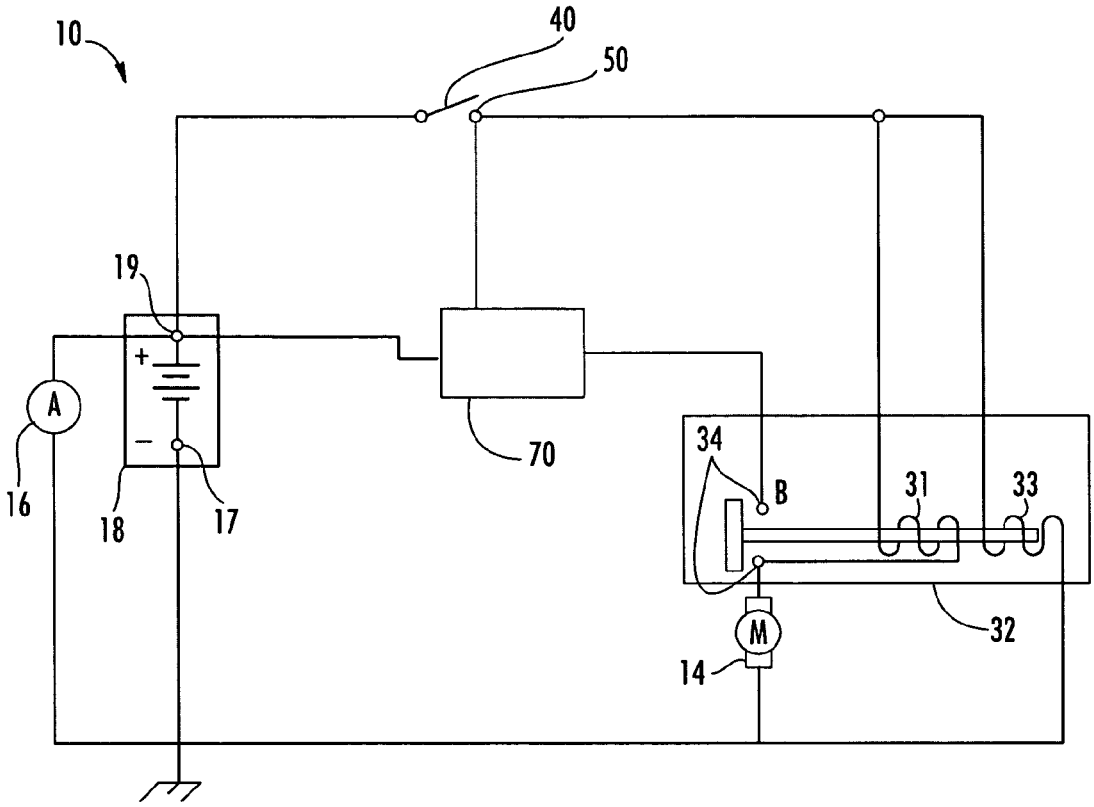
FIG. 4 is a schematic diagram showing an engine starting motor anti-milling device according to an embodiment of the present invention connected to other components of an internal combustion engine starting circuit.

FIG. 4 shows a schematic diagram of a internal combustion engine starting system 10 according to another embodiment of the present invention. Starting system 10 of FIG. 4 comprises starter motor 14, alternator 16, battery 18, capacitor 30, solenoid 32, switch 40, and current booster 70. Starter motor 14, alternator 16, battery 18, capacitor 30, solenoid 32, and switch 40 are described above in reference to FIGS. 1 and 2. Current booster 70 is operable to enhance the current delivered from battery 18 to starter motor 14. In an embodiment, current booster 70 comprises a DC-to-DC converter circuit operable to boost the voltage of battery 18, thereby delivering additional cranking current to starter motor 14.

In the embodiment of starting system 10 shown in FIG. 4, when switch 40 is closed, current flows from battery 18 to pull-in coil 31 and hold-in coil 33 of solenoid 32, causing contacts 34 to close. Closing contacts 34 short-circuits pull-in coil 31, and current flows from battery 18 to starter motor 14 causing the pinion gear (not shown) of starter motor 14 to engage the flywheel ring gear of the motor vehicle engine. The current flow/voltage change through switch 40 is detected by current booster 70 at node 50. Current booster 70 then is activated a predetermined period of time after the current flow/voltage change is detected at node 50. When activated, current booster 70 boosts the voltage of battery 18, thereby delivering additional cranking current to starter motor 14. Because of the delay implemented by current booster 70, the stepped up current is not delivered to starter motor 14 until the pinion gear of starter motor 14 has been given the opportunity to fully engage the flywheel ring gear of the internal combustion engine.

In an embodiment of the present invention, current booster 70 is activated two-tenths (0.2) of a second after switch 40 is closed, and deactivates thirty (30) seconds later or twenty-five (25) seconds after sensing a condition of greater than 14 volts at node 50. Other timing parameters may be selected according to the needs of a practitioner of the present invention, with each selected parameter falling within the scope of the present invention.

While this invention has been described as having a preferred design, the present invention can be further modified within the scope and spirit of this disclosure. This application is therefore intended to cover any variations, uses, or adaptations of the invention using its general principles. Each such implementation falls within the scope of the present invention as disclosed herein and in the appended claims. Furthermore, this application is intended to cover such departures from the present disclosure as come within known or customary practice in the art to which this invention pertains and which fall within the limits of the appended claims.

We claim:

1. A starting system for an internal combustion engine, the starting system comprising:

a battery;

an electric starter motor;

a first switch operable to make and break an electrical connection between said battery and said electric starter motor;

means for storing an electric charge;

a second switch operable to make and break an electrical connection between said electric starter motor and said means for storing an electric charge; and a sensor operable to detect a predetermined electrical parameter in said electrical connection between said battery and said electric starter motor and to transmit a signal actuating said second switch.

2. The starting system of claim 1, wherein said predetermined electrical parameter is a voltage threshold.

3. The starting system of claim 1, wherein said predetermined electrical parameter is a current threshold.

4. The starting system of claim 1, wherein said signal actuating said second switch comprises a control signal causing said second switch to make an electrical connection between said electric starter motor and said means for storing an electric charge, said control signal being transmitted a predetermined time after said predetermined electrical parameter is detected.

5. The starting system of claim 4, wherein said predetermined time is at least about 0.2 seconds.

6. The starting system of claim 1, wherein said signal actuating said second switch comprises a control signal causing said second switch to break an electrical connection between said electric starter motor and said means for storing an electric charge, said control signal being transmitted a predetermined time after said predetermined electrical parameter is detected.

7. The starting system of claim 6, wherein said predetermined time is at least about 25 seconds.

8. The starting system of claim 1, wherein said means for storing an electric charge comprises one or more capacitors.

9. The starting system of claim 1, wherein said means for storing an electric charge comprises one or more batteries.

10. A starting system for an internal combustion engine comprising:

an electric starter motor;

a battery electrically connected to said electric starter motor via a switched electrical connection; and a unitary control module, said unitary control module comprising:

(i) a housing, (ii) means for storing an electric charge, said means for storing an electric charge disposed within said housing, (iii) a sensor disposed within said housing, said sensor operable to detect a predetermined electrical parameter in said switched electrical connection between said electric starter motor and said battery, and (iv) a switch disposed within said housing, said switch operable to make and break an electrical connection between said means for storing an electric charge and said starter motor, said switch being responsive to a signal from said sensor.

11. The starting system for an internal combustion engine of claim 10, wherein said predetermined electrical parameter is a voltage threshold.

12. The starting system for an internal combustion engine of claim 10, wherein said predetermined electrical parameter is a current threshold.

13. The starting system for an internal combustion engine of claim 10, wherein said signal comprises a control signal causing said switch to make an electrical connection between said starter motor and said means for storing an electric charge, said control signal being transmitted a predetermined time after said predetermined electrical parameter is detected.

14. The starting system for an internal combustion engine of claim 13, wherein said predetermined time is at least about 0.2 seconds.

15. The starting system for an internal combustion engine of claim 10, wherein said signal comprises a control signal causing said switch to break an electrical connection between said electric starter motor and said means for storing an electric charge, said control signal being transmitted a predetermined time after said predetermined electrical parameter is detected.

16. The starting system for an internal combustion engine of claim 15, wherein said predetermined time is at least about 25 seconds.

17. The starting system of claim 10, wherein said means for storing an electric charge comprises one or more capacitors.

18. The starting system of claim 10, wherein said means for storing an electric charge comprises one or more batteries.

19. A starting system for an internal combustion engine, the starting system comprising:

a battery;

an electric starter motor comprising a moveable pinion gear drive shaft;

a first switch operable to make and break an electrical connection between said battery and said electric starter motor;

means for storing an electric charge;

a second switch operable to make and break an electrical connection between said electric starter motor and said means for storing an electric charge; and a sensor operable to actuate said second switch upon detecting that said moveable pinion gear drive shaft is in a predetermined position.

20. The starting system of claim 19, wherein said means for storing an electric charge comprises one or more capacitors.

21. The starting system of claim 19, wherein said means for storing an electric charge comprises one or more batteries.

* * * * *